United States Patent [19]

Blackett, Jr.

[11] 4,034,648

[45] July 12, 1977

[54] RECIPROCATING CYLINDER ASSEMBLY FOR SELF-PROPELLED SPRINKLER SYSTEMS

[75] Inventor: Ned K. Blackett, Jr., North Ogden, Utah

[73] Assignee: Dynapac, Inc., Salt Lake City, Utah

[21] Appl. No.: 640,971

[22] Filed: Dec. 15, 1975

[51] Int. Cl.[2] ..... F01L 21/04

[52] U.S. Cl. ..... 91/229; 91/337; 92/111

[58] Field of Search ..... 91/229, 337

[56] References Cited

U.S. PATENT DOCUMENTS

| | | | |
|---|---|---|---|
| 2,255,395 | 9/1941 | Spink | 91/229 |
| 2,295,880 | 9/1942 | Valois et al. | 91/229 |
| 2,555,018 | 5/1951 | Seggern | 91/337 |
| 2,799,226 | 7/1957 | Kangas | 91/229 |
| 2,987,051 | 6/1961 | Goyett et al. | 91/229 |

*Primary Examiner*—Paul E. Maslousky

*Attorney, Agent, or Firm*—Criddle, Thorpe & Western

[57] ABSTRACT

A reciprocating cylinder assembly for self-propelled sprinkler systems and the like comprising a cylinder tube having hollow plugs at each end having slidably engaged therein, a piston rod, said piston rod being surrounded by a repositionable valve slide and a piston. The piston rod projects through the hollow plugs at each end of the cylinder tube and have fluid inlet and outlet means at each end of the piston rod. When pressurized fluid is delivered to one end of the piston rod, the piston rod moves relative to the cylinder in a direction opposite to the direction of the entering fluid, and fluid is forced from the outlet at the opposite end of the piston rod until the valve slide engages the end plug of the cylinder tube whereupon pressure causes valve detents to slidably change positions thereby causing a reversal of fluid flow and the change of direction in the movement of the piston rod.

4 Claims, 3 Drawing Figures

RECIPROCATING CYLINDER ASSEMBLY FOR SELF-PROPELLED SPRINKLER SYSTEMS

BACKGROUND OF THE INVENTION

This invention relates to reciprocating cylinder valves to drive self-propelled sprinkler systems and the like. More particularly, this invention relates to a self-contained reciprocating cylinder assembly for the propulsion of sprinkler systems and the like by hydraulic means.

Self-propelled sprinkler irrigation systems are well known in the art. Such systems have been developed to carry long lengths of conduit pipe. Usually lengths of pipe will be supported at various intervals by towers which consist of a framework mounted on wheels which are self-propelled by various means. These sprinkling systems ordinarily will cover a quarter section of land, and as such, the pipe or conduit may be as long as 1320 feet. Various methods have been proposed to propel the towers to keep the pipe or conduit in alignment and when the pipe or conduit bends, either by lagging behind or getting too far ahead, responsive means will actuate a hydraulically or electrically driven system which will cause the towers to speed up or slow down so as to remain substantially in alignment.

Normally, such sprinkler systems move in a circular motion around a pivotal point containing the water source, and the movement or motion of each tower must be separately regulated. Means are disclosed in U.S. Pat. Nos. 3,386,661 and 3,766,937 for hydraulically actuating a bar which interconnects lugs associated with the wheels on the tower. These bars contain hooks which engage with the lugs in response to the reciprocating motion of a cylinder thereby causing the tower wheels to move the distance between the lugs associated with the tower wheels upon each reciprocating movement of the cylinder.

In U.S. Pat. No. 3,386,661 the hydraulic system is an enclosed system which extends along the entire length of the irrigating conduit, and the hydraulic fluid is powered or compressed by means of a single pump. In U.S. Pat. No. 3,766,937 there is an individual drive or self-contained fluid system associated with each tower. In each of these patents, however, the drive means at each tower is provided by a double-action, hydraulically actuated piston.

OBJECTS OF THE INVENTION

It is an object of the present invention to provide an improved reciprocating cylinder assembly consisting of a double-action piston.

It is also an object of this invention to provide a self-contained, hydraulically operated, self-reversing valve cylinder for use in drive systems for self-propelled sprinklers and the like.

A still further object of the invention is to provide an improved self-reversing valve cylinder system wherein the double-acting piston and the cylinder assembly require a minimum of power and is relatively maintenance free.

The principal features of this invention include a reciprocating cylinder assembly comprising a cylinder tube encased at either end by a hollow plug. Extending through the plug is a piston rod having encased thereabout in the cylinder tube, two valve slides held in place by valve detents, which valve slides are capable of changing from one position to another to allow a shift in flow of the hydraulic fluid. Separating the valve slides, and in sealing relationship with the inside of the cylinder tube, is a piston. Inlet and outlet tubes are located at each end of the piston rod and operate in such a manner that when hydraulic fluid under pressure is forced into the inlet at one end of the piston rod, the fluid will flow into the cylinder chamber at the inlet end thereby forcing the piston and valve slide assemblies to move in an opposite direction. When the slide valve located opposite the end at which the hydraulic fluid is entering the cylinder reaches the cylinder plug, the piston and piston rod continue movement in the opposite direction forcing detents in the slide valves held in place by detent springs to compress and slide into adjacent notches thereby shutting off the flow of hydraulic fluid into the inlet and opening a chamber whereby said fluid can flow into the outlet on that side of the valve. At the same time the movement of the slide valves allows hydraulic fluid to enter the opposite end of the cylinder forcing the piston, piston rods and slide valves in the opposite direction thus repeating the cycle.

With the foregoing objects and principal features in view, all of which more fully appear hereinafter, the invention, including the parts and combinations, will be better understood with reference to the following description and drawings. It is to be understood, however, that the description and drawings are for the purposes of illustration only and are not intended as a definition as to the scope of the invention.

DRAWINGS OF THE INVENTION

Figure 1:
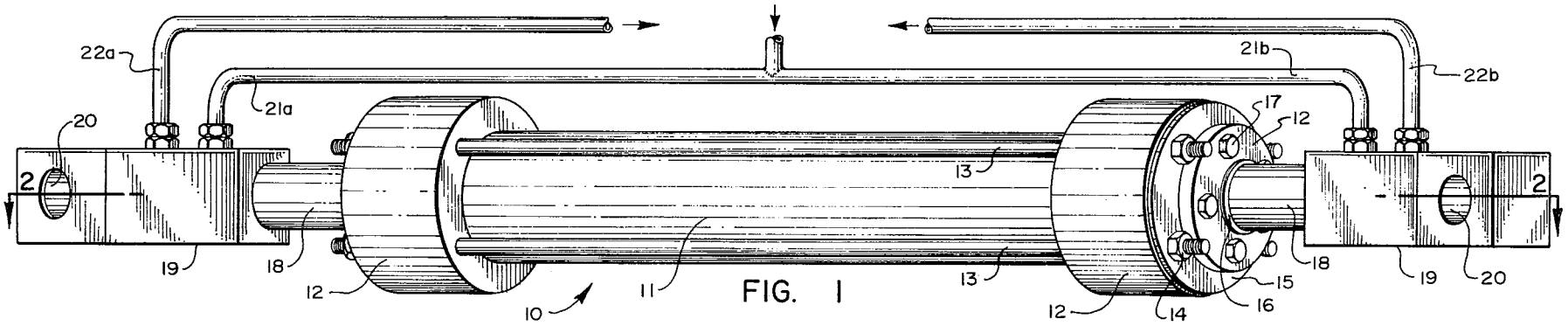
FIG. 1 is a perspective view of the reciprocating cylinder as claimed in the present invention.

There is shown in FIG. 1 a perspective overall view of the reciprocating valve assembly 10 consisting of a cylinder tube 11 having end plugs 12 secured at either end thereof by means of fastening bolts 13 threaded at each end having nuts 14 secured thereto. A cylinder sealing plug 15 is seated into end plug 12 and contains a fluid tight seal 16. The seal plug is bolted into the end plug by means of bolts 17.

Extending through the cylinder and in fluid tight relationship with the end plugs is reciprocating piston rod 18, the internal mechanism of which will be subsequently described in detail. Attached to each end of piston rod 18 is a piston rod clevis 19 which has means therein for securing driving rods 20 to carry the power or energy developed in the reciprocating cylinder to moving means not shown. Also contained in clevis rods 19 are hydraulic hoses 21 and 22 which serve as means to supply and release hydraulic fluid to the cylinder tube in a manner that will be subsequently described in detail.

Figure 2:
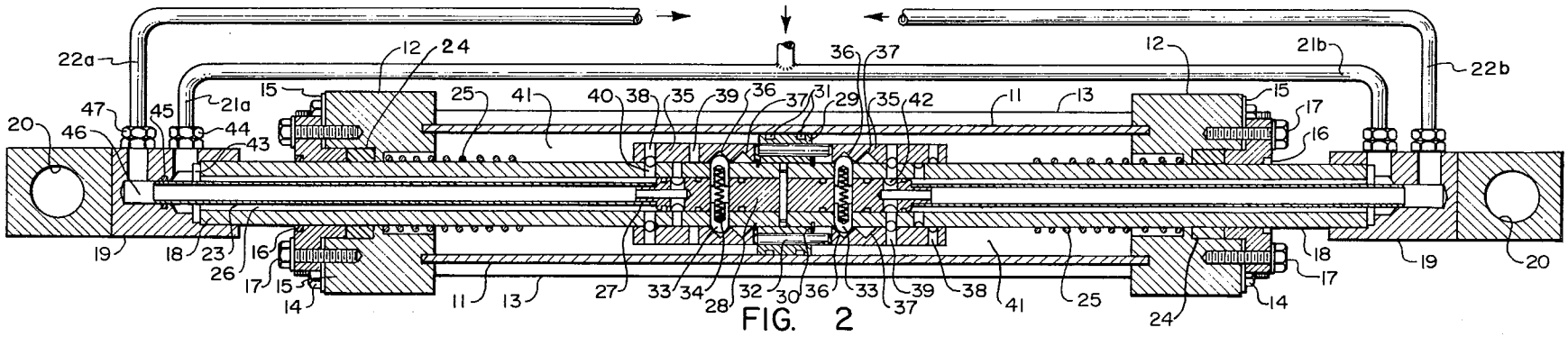
FIG. 2 is a longitudinal cross sectional view taken along lines 2—2 of FIG. 1 with the piston and valve slide assemblies in a central position, but which does not show connecting hose arrangements.
Figure 3:
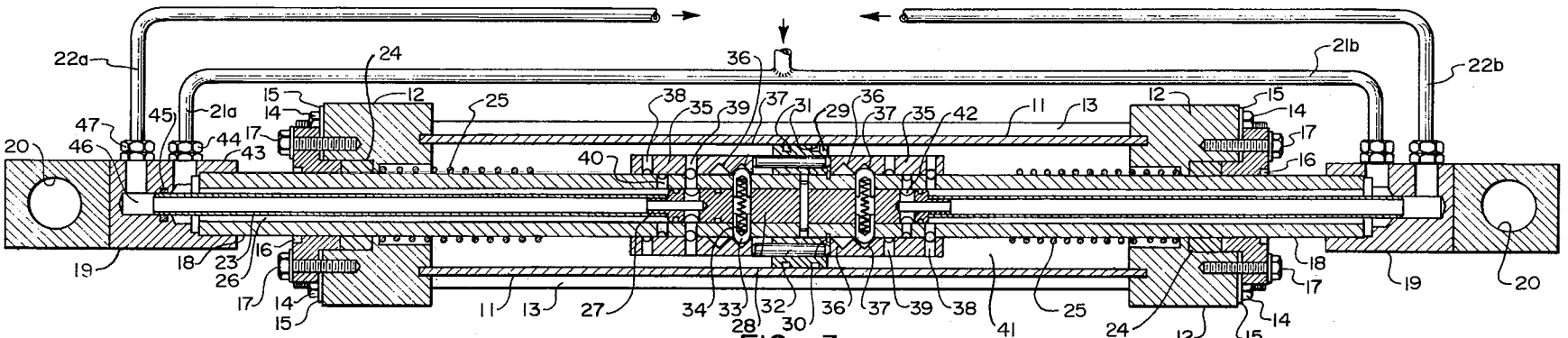
FIG. 3 is a view similar to FIG. 2 showing the piston and valve slide assemblies in an opposite position.

The internal workings of the reciprocating cylinder assembly 10 can be best described with reference to FIGS. 2 and 3. There is shown in these FIGURES a longitudinal cross sectional view of the reciprocating cylinder assembly with the valves in different operating positions. The valve assembly consists generally of a fluid tight cylinder as already described wherein the end plugs additionally contain packing material 24 which is held in fluid tight relationship around piston rod 18 by means of the cylinder sealing lug 15. Inside the cylinder each end plug 12 contains a circular indentation which serves as a housing for cylinder shaft spring 25, one of which is located at either end of the cylinder. The piston rod 18 contains a hollow cavity 26 which extends from the outer end thereof; being terminated at the inner portion by means of a protruding nipple 27 which serves as a means for seating cylinder outlet tube 23 which is inserted into cavity 26. As seen in FIGS. 2 and 3, the center of piston rod 18 consists of a solid core portion 28. Surrounding the piston rod at the center of portion 28 is a piston 29 held in place by means of piston retaining rings 30. Embedded in the circumference of the piston and in fluid tight relationship with cylinder wall 11 are piston rings 31. Slidably engaged in piston 29 are at least two cylinder valve push rods 32 which function to reverse valve positions thereby allowing the piston to reciprocate as will be described. Dissecting the solid core portion 28 of piston rod 18 on either side of the piston are valve detents 33 consisting of two pieces having a spring 34 interposed between. On either side of the piston 29 and held in position by valve detents 33 are valve slides 35. As illustrated in FIGS. 2 and 3, valve slides 35 contain notches 36, 37 adapted to receive the valve detents thereby holding the valve slides in one of two positions. The valve slides 35 contain apertures 38 and 39 which serve to control the inlet and outlet flow of hydraulic fluid from within the chambers of the cylinder tube 11. For example, when the valve detents are in the notches as illustrated in FIG. 2, hole 38 will be in register with hole 40 in the wall of the piston rod which opens into piston rod cavity 26. Fluid thereby entering through inlet tube 21*a* will travel through piston rod cavity 26 and through apertures 40 and 38 into cylinder cavity 41 thereby forcing the piston to move in the opposite direction, or as illustrated in FIG. 2, is so positioned that aperture 39 is in register with aperture 42 which is interconnected with cylinder outlet tube 23, thereby forcing fluid out of cylinder cavity 41 on the right hand side of the piston through apertures 39 and 42, and through the cylinder outlet tube 23 into hose 22*b*.

As illustrated in FIG. 3, when the piston and valve slide assemblies have been driven to the right, the valve slide comes into contact with a compression spring 25 to cushion the impact of the valve slide with the end cap 12. After impact of the valve slide 35, against end cap 12, continued hydraulic pressure on piston 29 will move the piston connected to the piston rod by retaining rings 30 further to the right thereby overcoming the holding force of valve detent springs 34 and valve detent 33, and moving them to the adjacent notches 36, 37 to the right in the valve slides. This repositions the ports designated by apertures 38, 39, 40 and 42 so that an identical reverse flow from the flexible inlet hose 21*b* on the right side will drive the piston and valve assembly to the left while discharge of hydraulic fluid will be made from the left side of the valve through outlet tube 22*a*. The cylinder valve push rods 32 extend slidably through piston 29 to allow simultaneous stopping of the slide valves while allowing continued movement of the piston.

The piston rod clevis 19 is adapted to fit over the end of piston rod 18 and contains apertures therein. Aperture 43 opens into piston rod cavity 26 and is connected to inlet hose 21 by means of fitting 44. Cylinder outlet tube 23 will extend through aperture 43 and be sealed therefrom by means of an O ring 45. The end of cylinder outlet tube 23 will be seated into the aperture 46 which connects outlet hose 22 by means of fitting 47.

In operation, hydraulic fluid is pumped into inlet hoses 21a or 21b depending upon the positioning of valve slides 35. The entering fluid will be forced into aperture 43 and into piston rod cavity 26 and out through the port contained by alignment of holes 38 and 40 into the cylinder aperture 41. The pressure of the fluid will force the piston in the opposite direction forcing hydraulic fluid out through port created by the alignment of apertures 39 and 42, into cylinder outlet tube 23, into aperture 46 and out through outlet hose 22 into a reservoir for recycling. As the piston rod reciprocates, drive rods 20 connected to either end of clevis block 19 will also move back and forth providing the necessary power to drive lugs connected to wheels, as illustrated in either U.S. Pat. No. 3,396,661 or U.S. Pat No. 3,766,937. The hydraulic fluid may be pressurized by means of a pump operated by either an electric motor or a gasoline operated engine. Preferably, each tower will be self-contained, however, one pump may be used with interconnecting fluid lines to each tower.

Although the invention, as has been described, is deemed to be that which would form the preferred embodiment of the invention, it is recognized that departures may be made therefrom without departing from the scope of the invention which is not to be limited to the details disclosed, but is to be accorded the full scope of the claims so as to include any and all equivalent devices.

What is claimed is:

1. A reciprocating valve assembly comprising:

a. a cylinder tube encased at both ends by end plugs containing apertures therein, b. a piston rod slidably engaged in fluid tight relationship through said end plugs in the cylinder tube, and having hollow end portions and a solid center core, each end of said center core containing seating means protruding outwardly therefrom and containing a passageway extending inwardly from said seating means into the center core a predetermined distance, said piston rod containing four operatives apertures adjacent the core ends and four additional apertures extending into the passageways of said solid core, c. a piston surrounding the solid center core of the piston rod said piston being slidably engaged against the inner walls of the cylinder tube in fluid tight relationship thereby creating a fluid tight cylinder cavity on each side of the piston between the piston and said end plugs, d. valve push rods of a predetermined length frictionally mounted in the piston parallel to the piston rod, e. cylindrical slide valves which are separated from each other by the length of the valve push rods surrounding the piston rod on each side of the piston, each of said slide valves containing two notches adjacent the piston rod and also containing two sets of apertures, said valve slides being so positioned that one set of said slide valve apertures in one valve slide will be in alignment with the apertures on one side of the solid core of the piston rod and the other set of slide valve apertures in the other valve slide will be in alignment with the apertures extending into the passgeway of the solid core of the piston rod, f. valve detents containing interposed valve springs inserted through the solid piston rod core on each side of the piston which are adapted to fit into the notches in the valve slides and be repositioned from one valve slide notch to the adjacent notch by means of hydraulic pressure, g. compression springs mounted around the piston rod at either end of the cylinder tube adjacent the end plugs, h. cylinder outlet tubes seated about the seating means of the solid core in communication with the solid core passageway and extending outwardly past the ends of the hollow piston rod portion thereby creating a piston rod cavity on either side of the solid core between the outer walls of the cylinder outlet tube and the inner walls of the hollow piston rod portions, i. a clevis block fixedly attached to each end of the piston rod and containing apertures therein, one aperature of which is adapted to be in lfuid tight engagement with the piston rod cavity, and the other aperature of which is adapted to be in fluid tight relationship with the outer end of the cylinder outlet tubes, j. inlet hydraulic hoses attached to the clevis blocks into the apertures engaged with each piston rod cavity, k. outlet cylinder hoses attached to the clevis blocks into the aperatures engaged with each cylinder outlet tube, and the other set of slide valve aperatures.

l. drive means attached to the outside ends of each clevis block.

2. A reciprocating valve assembly according to claim 1 wherein the piston is held in place by means of retention rings securely engaged on either side of the piston around the piston rod.

3. A reciprocating valve assembly according to calim 2 wherein the notches in the slide valves are separated by a predetermined distance which is the same distance that the valve push rods extend beyond the piston walls.

4. A reciprocating valve assembly as claimed in claim 3 wherein the valve detents in the valve slides are in opposing notches such that when hydrualic fluid is forced into the piston rod cavity from the inlet hydraulic hose at one end of the piston rod, said fluid will flow successively through the piston rod cavity out through the set of apertures on one side of the solid center core of the piston rod and through the set of apertures in the valve slide in alignment therewith into the cylinder cavity thereby forcing the piston to move in an opposite direction, while at the same time, the valve slide on the opposite side of the piston is in such a position that one set of apertures therein is in alignment with the set of apertures extending into the passageway in the solid center core of the piston rod whereby fluid in the cylinder cavity of said opposite side of the piston is forced through the set of apertures in the valve slide and the set of apertures extending into the passageway of the solid center core and is further forced through said passageway and cylinder outlet tube into the outlet hydraulic hose allowing said piston to move in the direction of the outflowing fluid until the valve slide reaches the compression spring at the end of the cylinder tube in the direction the piston is moving whereupon the spring is compressed and the valve slide comes in contact with the end plug whereupon the force exerted by the compression spring in one direction and the force of the hydraulic fluid against the piston in the other direction cause the valve slides to stop movement while the piston and piston rod continue movement causing the valve detents to compress and the piston rod to move causing the valve detents to shift into opposing notches thereby reversing the flow of hydraulic fluid and the movement of the piston, piston rod and valve slides.

* * * * *